US008277202B2

(12) United States Patent
Nishikawa et al.

(10) Patent No.: US 8,277,202 B2
(45) Date of Patent: Oct. 2, 2012

(54) MULTICYLINDRICAL ROTARY COMPRESSOR

(75) Inventors: Takahiro Nishikawa, Gunma-ken (JP); Hirotsugu Ogasawara, Ota (JP); Masayuki Hara, Ota (JP); Hiroyuki Sawabe, Ota (JP)

(73) Assignee: Sanyo Electric Co., Ltd., Moriguchi-Shi (JP)

( * ) Notice: Subject to any disclaimer, the term of this patent is extended or adjusted under 35 U.S.C. 154(b) by 434 days.

(21) Appl. No.: 11/296,379

(22) Filed: Dec. 8, 2005

(65) Prior Publication Data

US 2006/0222511 A1 Oct. 5, 2006

(30) Foreign Application Priority Data

Dec. 21, 2004 (JP) ..... 2004-369117

(51) Int. Cl.
*F04B 49/00* (2006.01)
*F04B 53/00* (2006.01)

(52) U.S. Cl. ..... 417/213; 417/310

(58) Field of Classification Search ..... 417/213, 417/231, 26, 45, 53, 410.1, 423.1; 418/63, 418/23–27

See application file for complete search history.

(56) References Cited

U.S. PATENT DOCUMENTS 4,452,570 A * 6/1984 Fujisaki et al. ..... 417/286
4,726,739 A * 2/1988 Saitou et al. ..... 417/286
4,780,067 A * 10/1988 Suzuki et al. ..... 417/441
4,826,408 A * 5/1989 Inoue et al. ..... 418/60
5,013,217 A * 5/1991 Hitosugi ..... 417/26
5,074,761 A * 12/1991 Hirooka et al. ..... 417/310
5,102,317 A * 4/1992 Okoma et al. ..... 418/60
5,152,156 A * 10/1992 Tokairin ..... 62/498
5,678,985 A * 10/1997 Brooke et al. ..... 417/299
5,775,882 A * 7/1998 Kiyokawa et al. ..... 417/310
5,823,755 A * 10/1998 Wilson et al. ..... 418/15
5,871,342 A * 2/1999 Harte et al. ..... 418/6
6,102,677 A * 8/2000 Iida et al. ..... 417/463
6,212,893 B1 * 4/2001 Ban et al. ..... 62/117
6,280,168 B1 * 8/2001 Matsumoto et al. ..... 418/151
6,293,767 B1 * 9/2001 Bass ..... 417/310
6,336,800 B1 * 1/2002 Kim et al. ..... 418/63
6,447,274 B1 * 9/2002 Horihata et al. ..... 418/60
6,533,558 B1 * 3/2003 Matsumoto et al. ..... 417/410.3

(Continued)

FOREIGN PATENT DOCUMENTS

CN 1071853 C 9/2001

(Continued)

OTHER PUBLICATIONS

Chinese Office Action dated Mar. 10, 2010 (in Chinese).
Japanese Office Action dated Feb. 16, 2010 (in Japanese).
European Search Report dated Nov. 17, 2009.

*Primary Examiner* — Charles Freay
*Assistant Examiner* — Alexander Comley
(74) *Attorney, Agent, or Firm* — Kratz, Quintos & Hanson, LLP

(57) ABSTRACT

There is disclosed a multicylindrical rotary compressor capable of improving an operation efficiency during a small-capacity operation, the compressor comprises a controller as a control unit which adjusts a rotation number of an electromotive element as a driving element and which controls an operation of a power saving mechanism, and the controller operates the power saving mechanism to connect a high-pressure chamber side of a first cylinder to a low-pressure chamber side of a second cylinder during the small-capacity operation of a refrigerant circuit constituted in a rotary compressor (the multicylindrical rotary compressor).

5 Claims, 5 Drawing Sheets

U.S. PATENT DOCUMENTS

| | | | | |
|---|---|---|---|---|
| 6,551,069 | B2 * | 4/2003 | Narney et al. | 417/53 |
| 6,716,007 | B2 * | 4/2004 | Kim et al. | 418/23 |
| 6,799,956 | B1 * | 10/2004 | Yap et al. | 418/60 |
| 6,932,588 | B2 * | 8/2005 | Choi et al. | 418/63 |
| 6,945,073 | B2 * | 9/2005 | Matsumoto et al. | 62/470 |
| 2004/0009083 | A1 * | 1/2004 | Kim et al. | 418/23 |
| 2004/0040339 | A1 * | 3/2004 | Matsumoto et al. | 62/470 |
| 2004/0131490 | A1 * | 7/2004 | Choi et al. | 418/23 |
| 2004/0175274 | A1 * | 9/2004 | Cho et al. | 417/213 |
| 2004/0241010 | A1 * | 12/2004 | Cho et al. | 417/274 |
| 2005/0008442 | A1 * | 1/2005 | Matsumoto et al. | 410/3 |
| 2005/0069442 | A1 * | 3/2005 | Cho et al. | 418/26 |

FOREIGN PATENT DOCUMENTS

| | | | |
|---|---|---|---|
| EP | 0222109 | A1 | 5/1987 |
| EP | 0724078 | A1 | 7/1996 |
| EP | 0854293 | A1 | 7/1998 |
| JP | 61-272492 | | 12/1986 |
| JP | 1-193089 | | 8/1989 |
| JP | 4-241791 | | 8/1992 |
| JP | 5-99172 | | 4/1993 |
| JP | 7-54782 | | 2/1995 |
| JP | 9-151891 | | 6/1997 |
| WO | WO 2004/083642 | A1 | 9/2004 |

* cited by examiner

MULTICYLINDRICAL ROTARY COMPRESSOR

BACKGROUND OF THE INVENTION

The present invention relates to a multicylindrical rotary compressor in which a rotation number of a driving element is controlled by control means.

Heretofore, in a mainstream of an air conditioner provided with this type of multicylindrical rotary compressor, a capability of the multicylindrical rotary compressor is controlled by a control unit depending on a capability on a use side (interior heat exchanger). Especially, in recent years, there have been many air conditioners in which a rotation number of the multicylindrical rotary compressor is linearly controlled using an inverter. Accordingly, it is possible to vary the rotation number of the multicylindrical rotary compressor arbitrarily from 0 to a predetermined rotation number.

This multicylindrical rotary compressor, for example, a two-cylinder rotary compressor provided with first and second rotary compression elements is constituted by storing a driving element and the first and second rotary compression elements driven by a rotation shaft of the driving element in a sealed container. The first and second rotary compression elements include: first and second cylinders, first and second rollers engaged with eccentric portions formed on the rotation shaft to rotate eccentrically in the respective cylinders, respectively; and first and second vanes which abut on the first and second rollers to divide each cylinder into low and high pressure chamber sides. The first and second vanes are constantly urged with respect to the first and second rollers by spring members.

Moreover, when the driving element is driven by the control unit, a low-pressure refrigerant gas is sucked into the low-pressure chamber side of the cylinder of each of the first and second rotary compression elements via a suction port, and compressed by the operations of each roller and each vane to constitute the refrigerant gas at high temperature and pressure. After the gas is discharged from the high-pressure chamber side of each cylinder into a discharge sound muffling chamber via a discharge port, the gas is discharged into the sealed container, and discharged to the outside (see, e.g., Japanese Patent Application Laid-Open No. 5-99172).

In such multicylindrical rotary compressor, the rotation number of the multicylindrical rotary compressor is lowered, and the compressor is operated based on an output of an inverter in a small-capacity operation under a light load or by a low-speed rotation. However, a problem has occurred that when the rotation number excessively lowers, an operation efficiency of the driving element drops, a leakage loss increases, and an operation efficiency remarkably drops.

SUMMARY OF THE INVENTION

The present invention has been developed to solve such conventional technical problem, and an object thereof is to provide a multicylindrical rotary compressor which can improve an operation efficiency during a small-capacity operation.

A first aspect of the present invention is directed to a multicylindrical rotary compressor in which a driving element and first and second rotary compression elements driven by a rotation shaft of the driving element are stored in a sealed container, the first and second rotary compression elements comprising: first and second cylinders; first and second rollers fitted into eccentric portions formed on the rotation shaft to eccentrically rotate in the respective cylinders, respectively; and first and second vanes which abut on the first and second rollers to divide each cylinder into a low-pressure chamber side and a high-pressure chamber side, respectively, the compressor comprising: a power saving mechanism which connects the high-pressure chamber side of the first cylinder to the low-pressure chamber side of the second cylinder with a predetermined phase; and control means for controlling an operation of the power saving mechanism and a rotation number of the driving element, the control means operating the power saving mechanism during a small-capacity operation of a refrigerant circuit constituted in the multicylindrical rotary compressor to connect the high-pressure chamber side of the first cylinder to the low-pressure chamber side of the second cylinder and to thereby raise the rotation number of the driving element.

A second aspect of the present invention is directed to the above multicylindrical rotary compressor further comprising a discharge port for discharging the refrigerant compressed in the first cylinder; and a discharge valve which opens or closes the discharge port, the control means controlling the power saving mechanism to connect the high-pressure chamber side of the first cylinder to the low-pressure chamber side of the second cylinder in the vicinity of a phase angle of the first roller in which the discharge valve opens during the small-capacity operation of the refrigerant circuit.

According to the present invention, the control means operates the power saving mechanism to connect the high-pressure chamber side of the first cylinder to the low-pressure chamber side of the second cylinder during the small-capacity operation of the refrigerant circuit constituted in the multicylindrical rotary compressor, the refrigerant on the high-pressure chamber side of the first cylinder can be released to the low-pressure chamber side of the second cylinder.

Accordingly, since an amount of the refrigerant discharged from the first cylinder decreases, an amount of the refrigerant sucked into the second cylinder decreases, and an amount of the circulated refrigerant flowing through the refrigerant circuit drops, the rotation number of the driving element can increase as much. It is possible to suppress the drop of the operation efficiency of the driving element during low-speed rotation or an increase of a refrigerant leak loss in each rotation compression element.

Moreover, when the control means controls the power saving mechanism to connect the high-pressure chamber side of the first cylinder to the low-pressure chamber side of the second cylinder in the vicinity of a phase angle of the first roller in which the discharge valve opens during the small-capacity operation of the refrigerant circuit, the refrigerant on the high-pressure chamber side of the first cylinder can be discharged to the low-pressure chamber side of the second cylinder with a good efficiency.

Furthermore, the refrigerant circuit of the freezing device is constituted in the multicylindrical rotary compressor of the above-described inventions. For example, the refrigerant circuit is constituted by connecting the multicylindrical rotary compressor, a heat-source-side heat exchanger, diaphragm means, and a use-side heat exchanger in an annular form via pipes, and the multicylindrical rotary compressor is controlled as in the respective inventions. Consequently, performance and reliability of the whole freezing device can be enhanced.

DETAILED DESCRIPTION OF THE PREFERRED EMBODIMENT

An embodiment of the present invention will be described hereinafter in detail with reference to the drawings.

Figure 1:
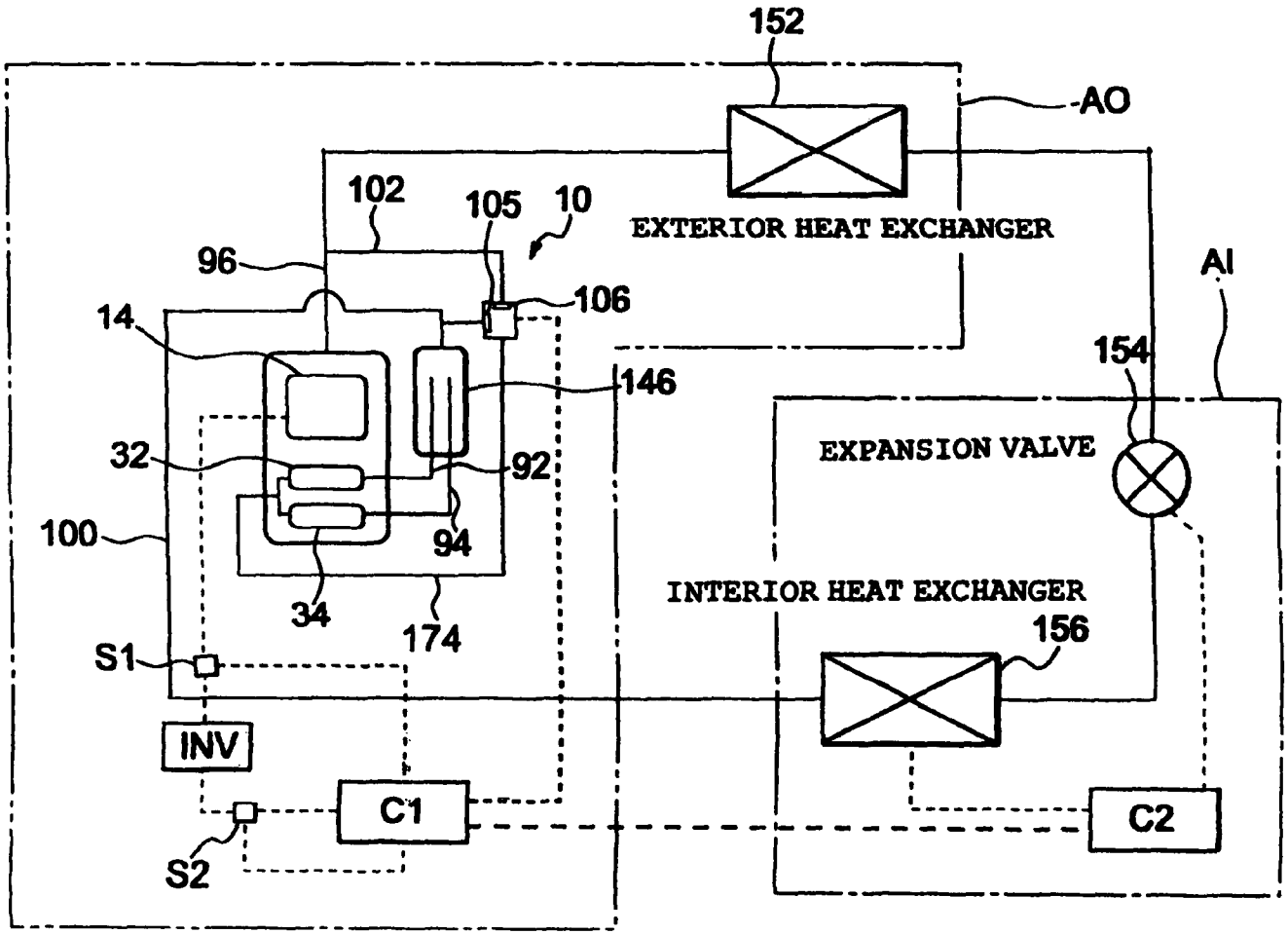
FIG. 1 is a refrigerant circuit diagram of a freezing device of the present invention.

FIG. 1 shows a refrigerant circuit diagram of an air conditioner as a freezing device in which a refrigerant circuit is constituted in a multicylindrical rotary compressor of the present invention. That is, the multicylindrical rotary compressor of the present embodiment constitutes a part of the refrigerant circuit of the air conditioner which conditions air in a room, and an operation of the compressor is controlled by a controller C1 described later. The refrigerant circuit of the air conditioner of the present embodiment is constituted by connecting a rotary compressor 10 (multicylindrical rotary compressor), an exterior heat exchanger 152 as a heat-source-side heat exchanger, an expansion valve 154 as diaphragm means, and an interior heat exchanger 156 as a use-side heat exchanger in an annular form via pipes.

Moreover, the rotary compressor 10 (multicylindrical rotary compressor), the exterior heat exchanger 152 and the like are installed in an exterior unit AO. The expansion valve 154, the interior heat exchanger 156 and the like are installed in an interior unit AI. That is, a refrigerant discharge tube 96 of the rotary compressor 10 is connected to an inlet of the exterior heat exchanger 152. A pipe connected to an outlet of the exterior heat exchanger 152 is connected to the expansion valve 154, and the pipe extending from the expansion valve 154 is connected to the interior heat exchanger 156. A refrigerant pipe 100 of the rotary compressor 10 is connected to an outlet side of the interior heat exchanger 156.

Figure 2:
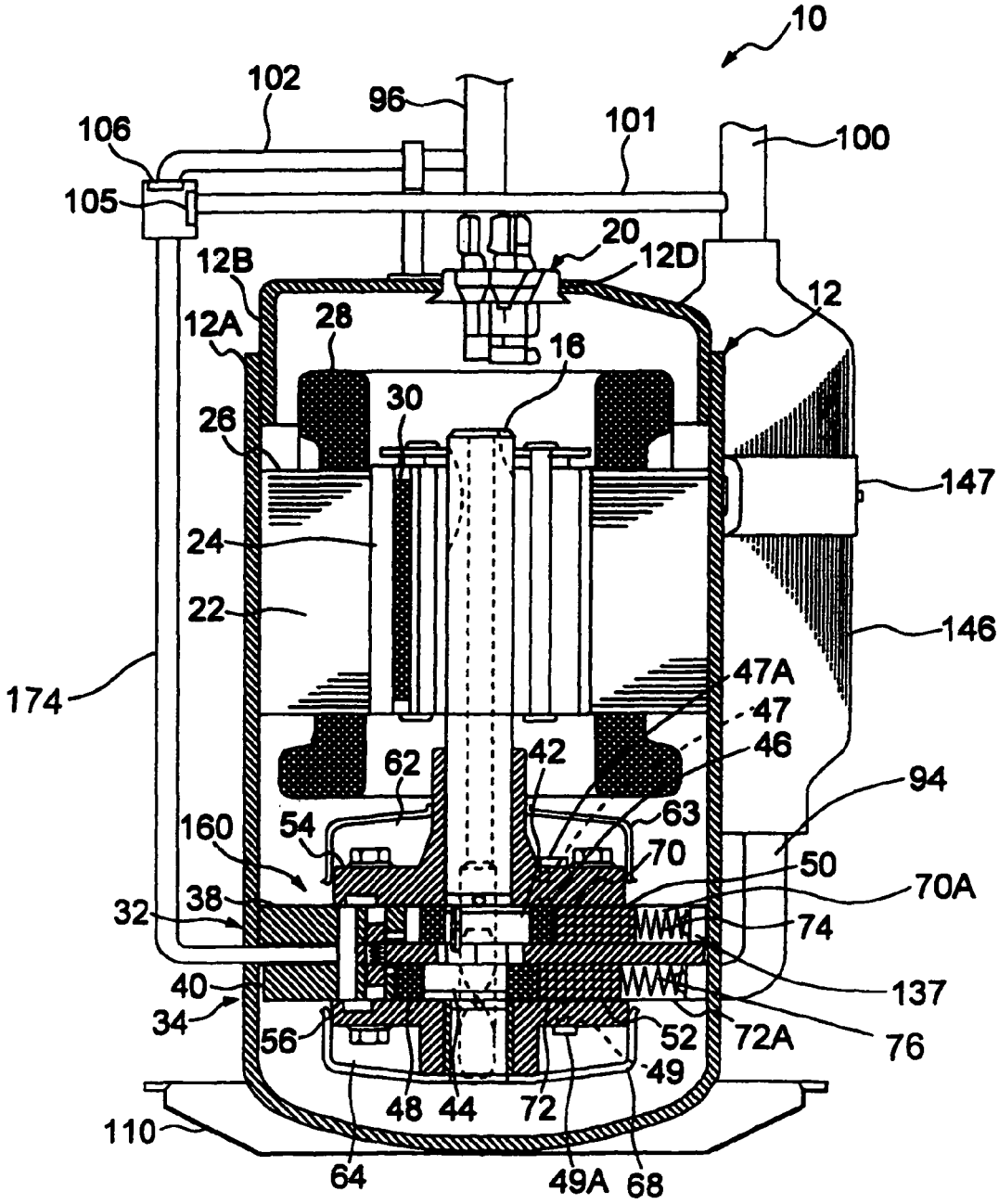
FIG. 2 is a vertical side view of a multicylindrical rotary compressor of FIG. 1.
Figure 3:
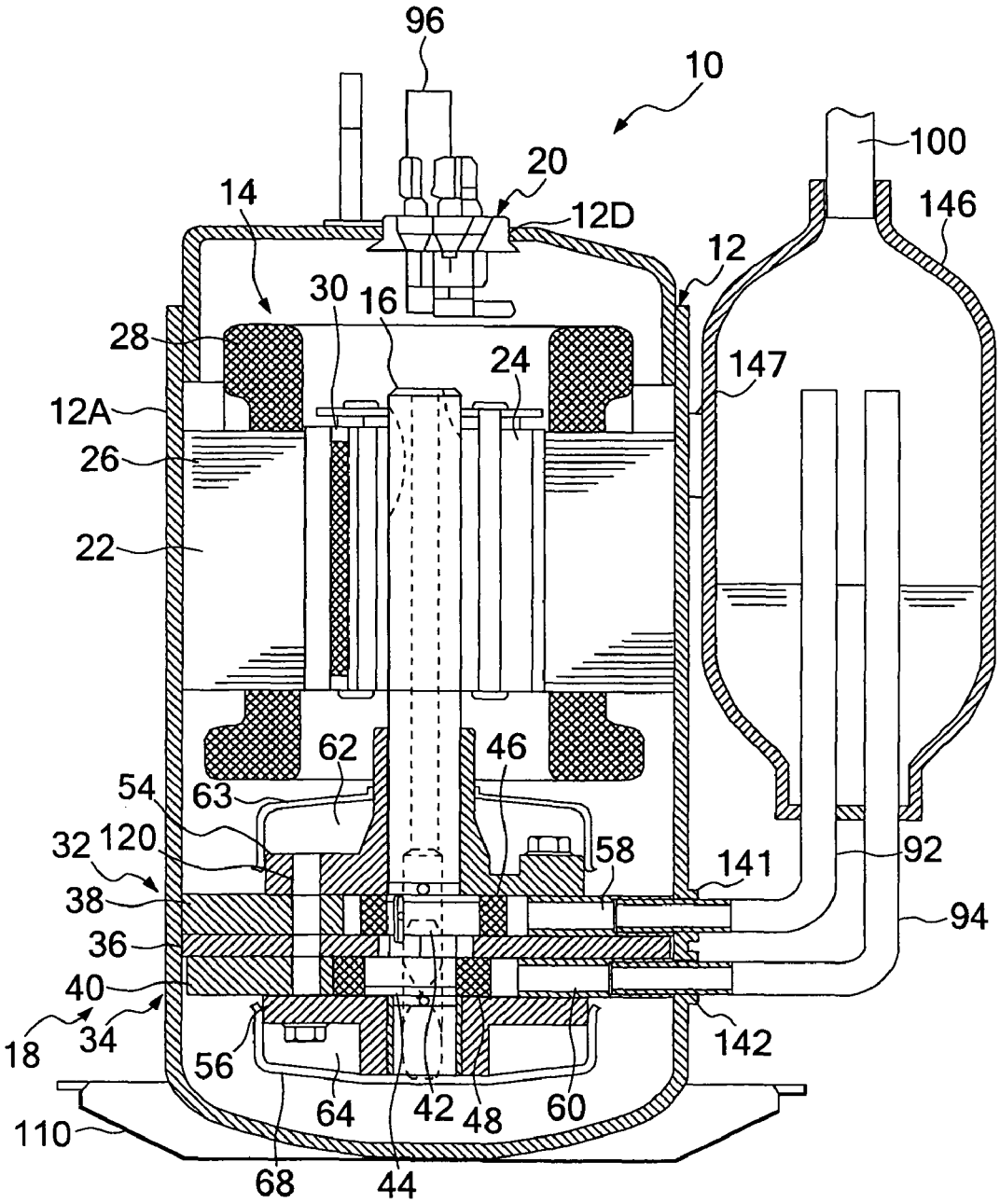
FIG. 3 is another vertical side view of the multicylindrical rotary compressor of FIG. 1.
Figure 4:
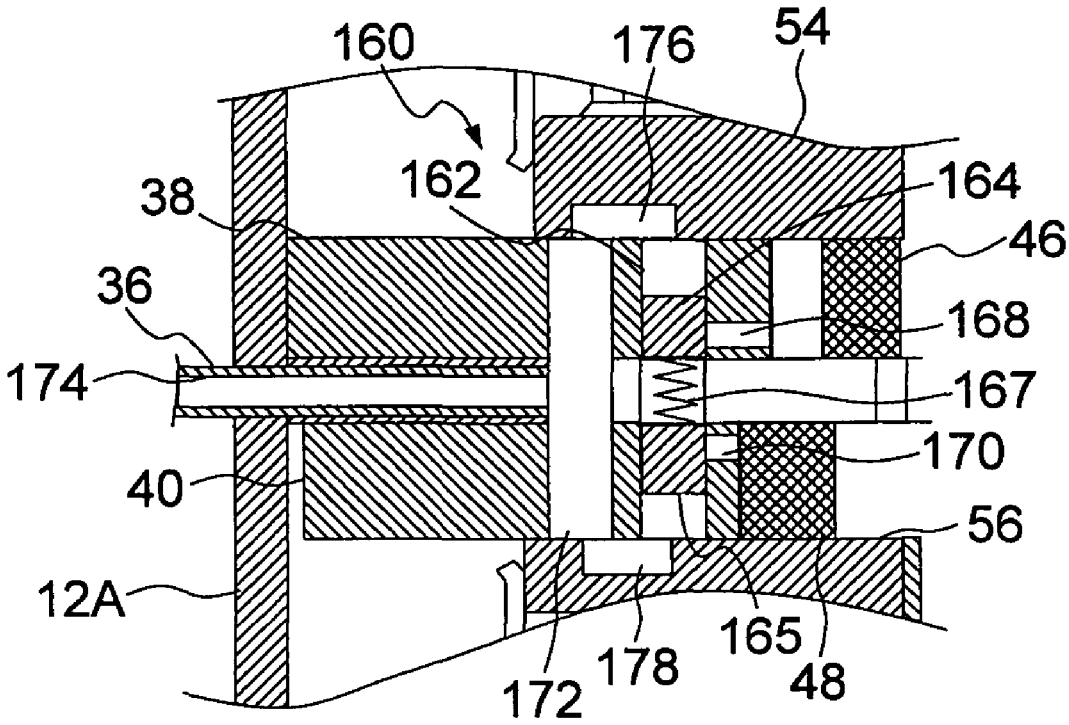
FIG. 4 is an enlarged view of a power saving mechanism of the multicylindrical rotary compressor of FIG. 1.
Figure 5:
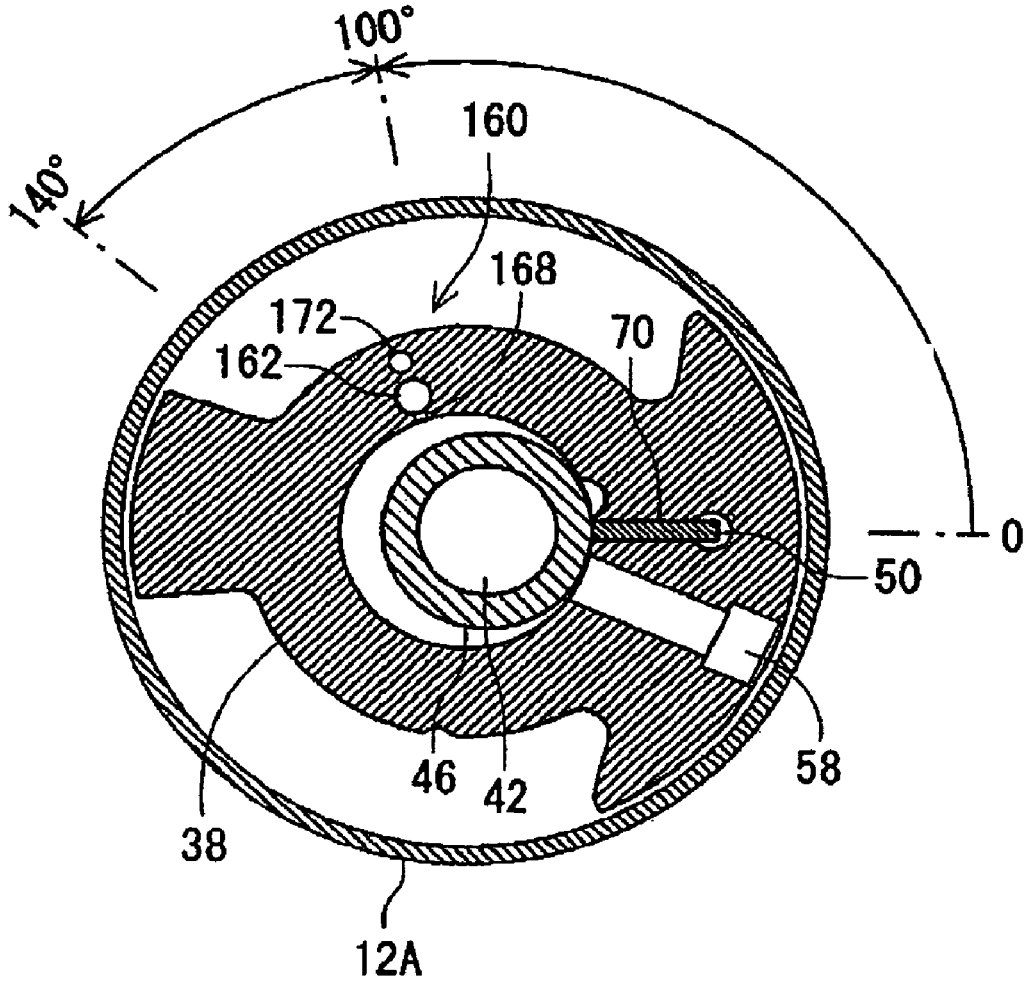
FIG. 5 is the plane cross section at the through hole 168 of the compressor.

In the present embodiment, as the multicylindrical rotary compressor, there is used the rotary compressor 10 of a high inner pressure type provided with first and second rotary compression elements 32 and 34. Here, a constitution of the rotary compressor 10 will be described with reference to FIGS. 2 and 3. FIGS. 2 and 3 show vertical side views of the rotary compressor 10, respectively.

In the drawings, the rotary compressor 10 of the present embodiment is a high inner pressure type of rotary compressor. In a vertically cylindrical sealed container 12 constituted of a steel plate, there are stored: an electromotive element 14 as a driving element disposed in an upper part of an inner space of this sealed container 12; and a rotary compression mechanism section 18 disposed under the electromotive element 14 and constituted of the first and second rotary compression elements 32 and 34 driven by a rotation shaft 16 of the electromotive element 14. It is to be noted that a rotation number of the electromotive element 14 of the rotary compressor 10 is controlled by an inverter INV.

The sealed container 12 is constituted of: a container main body 12A whose bottom portion is constituted as an oil reservoir and in which the electromotive element 14 and the rotary compression mechanism section 18 are stored; and a substantially cup shaped end cap (lid member) 12B to close an upper opening of the container main body 12A. Moreover, a circular attaching hole 12D is formed in the upper surface of this end cap 12B, and a terminal (wiring line is omitted) 20 for supplying power to the electromotive element 14 is attached to the attaching hole 12D.

Moreover, a refrigerant discharge tube 96 is attached to the end cap 12B, and one end of the refrigerant discharge tube 96 communicates with the sealed container 12. Furthermore, a bottom part of the sealed container 12 is provided with an attaching base 110.

The electromotive element 14 is constituted of: a stator 22 welded and fixed in an annular form along an inner peripheral surface of the sealed container 12; and a rotor 24 inserted with a slight interval inside this stator 22. This rotor 24 is fixed to the rotation shaft 16 which passes through the center of the element to extend in a vertical direction.

The stator 22 has: a laminate 26 constituted by laminating donut-shaped electromagnetic steel plates; and a stator coil 28 wound around a tooth portion of the laminate 26 by a direct winding (concentrated winding) system. The rotor 24 is constituted of a laminate 30 of electromagnetic steel plates in the same manner as in the stator 22.

An intermediate partition plate 36 is sandwiched between the first and second rotary compression elements 32 and 34. That is, the first and second rotary compression elements 32, 34 are constituted of: the intermediate partition plate 36; first and second cylinders 38, 40 disposed on and under this intermediate partition plate 36; first and second rollers 46, 48 fitted into upper and lower eccentric portions 42, 44 disposed on the rotation shaft 16 with a phase difference of 180 degrees in the first and second cylinders 38, 40 to rotate eccentrically in the respective cylinders 38, 40, respectively; first and second vanes 50, 52 which abut on the first and second rollers 46, 48 to divide the respective cylinders 38, 40 into a low-pressure chamber side and a high-pressure chamber side, respectively; and an upper support member 54 and a lower support member 56 as support members which close an upper open surface of the first cylinder 38 and a lower open surface of the second cylinder 40 and which also function as bearings of the rotation shaft 16.

Moreover, the first and second cylinders 38, 40 are provided with suction passages 58, 60 which communicate with the first and second cylinders 38, 40 via suction ports (not shown). The suction passages 58, 60 are connected to refrigerant introducing pipes 92, 94 described later.

Furthermore, a discharge sound muffling chamber 62 is disposed above the upper support member 54, and the refrigerant gas compressed by the first rotary compression element 32 is discharged to the discharge sound muffling chamber 62 via a discharge port 47. This discharge sound muffling chamber 62 is formed in a substantially cup-shaped member 63 whose center is provided with a hole for passing the rotation shaft 16 and the upper support member 54 also functioning as the bearing of the rotation shaft 16 and which covers the upper support member 54 on the side of the electromotive element 14 (upper side). Moreover, the electromotive element 14 is disposed above the cup member 63 with a predetermined interval from the cup member 63.

A discharge sound muffling chamber 64 is disposed under the lower support member 56, and a refrigerant gas compressed by the second rotary compression element 34 is discharged to the discharge sound muffling chamber 64 via a discharge port 49. The discharge sound muffling chamber 64 is formed in a substantially cup-shaped member 68 whose center is provided with a hole for passing the rotation shaft 16 and the lower support member 56 also functioning as the bearing of the rotation shaft 16 and which covers the lower support member 56 on the side opposite to the electromotive element 14 (lower side). Moreover, the respective cylinders 38, 40 on the high-pressure chamber side communicate with the respective discharge sound muffling chambers 62, 64 via the discharge ports 47, 49. A lower surface of the discharge sound muffling chamber 62 is provided with a discharge valve 47A which openably closes the discharge port 47. The discharge valve 47A is constituted of an elastic member made of a metal plate having a substantially vertically long rectangular shape, and a backer valve as a discharge valve press plate is disposed above the discharge valve 47A, and attached to the upper support member 54.

Moreover, one end of the discharge valve 47A abuts on the discharge port 47 to seal the port, and the other end thereof is fixed to an attaching hole (not shown) of the upper support member 54 disposed at a predetermined interval from the discharge port 47 with a caulking pin.

Furthermore, the refrigerant gas compressed in the first cylinder 38 to reach a predetermined pressure pushes up the discharge valve 47A which closes the discharge port 47 from below in the drawing. The gas opens the discharge port 47, and is discharged to the discharge sound muffling chamber 62. In this case, since the other end of the discharge valve 47A is fixed to the upper support member 54, one side thereof that abuts on the discharge port 47 warps upwards to abut on the backer valve that regulates an open amount of the discharge valve 47A. When it is a time to end the discharging of the refrigerant gas, the discharge valve 47A is detached from the backer valve to close the discharge port 47.

On the other hand, an upper surface of the discharge sound muffling chamber 64 is provided with a discharge valve 49A which openably closes the discharge port 49. The discharge valve 49A is constituted of an elastic member made of a metal plate having a substantially vertically long rectangular shape, and a backer valve as a discharge valve press plate is disposed above the discharge valve 49A, and attached to the lower support member 56 in the same manner as in the discharge valve 47A.

Moreover, one end of the discharge valve 49A abuts on the discharge port 49 to seal the port, and the other end thereof is fixed to an attaching hole (not shown) of the lower support member 56 disposed at a predetermined interval from the discharge port 49 with a caulking pin.

Furthermore, the refrigerant gas compressed in the second cylinder 40 to reach a predetermined pressure pushes up the discharge valve 49A which closes the discharge port 49 from above in the drawing. The gas opens the discharge port 49, and is discharged to the discharge sound muffling chamber 64. In this case, since the other end of the discharge valve 47A is fixed to the lower support member 56, one side thereof that abuts on the discharge port 49 warps upwards to abut on the backer valve that regulates an open amount of the discharge valve 49A. When it is a time to end the discharging of the refrigerant gas, the discharge valve 49A is detached from the backer valve to close the discharge port 49.

On the other hand, guide grooves 70, 72 in which the first and second vanes 50, 52 are contained are formed in both of the cylinders 38, 40. Storage portions 70A, 72A in which springs 74, 76 as spring members are stored are formed outwardly in the respective guide grooves 70, 72, that is, on back-surface sides of the respective vanes 50, 52. These springs 74, 76 abut on end portions of the vanes 50, 52 on the back-surface side, and the respective vanes 50, 52 are constantly urged on the side of the respective rollers 46, 48. A discharge-side pressure (high pressure) in the sealed container 12 described later is also introduced into the storage portions 70A, 72A and applied as back pressures of the respective vanes 50, 52. Moreover, the storage portions 70A, 72A open on the sides of the guide grooves 70, 72 and the sealed container 12 (container main body 12A). Plug 137 (lower plug is not shown) made of a metal are disposed on the springs 74, 76 stored in the respective storage portions 70A, 72A on the side of the sealed container 12, and prevent the respective springs 74, 76 from falling.

Sleeves 141, 142 are welded and fixed to positions of the first and second cylinders 38, 40 corresponding to the suction passages 58, 60 on the side surface of the container main body 12A of the sealed container 12. Moreover, one end of the refrigerant introducing tube 92 for introducing the refrigerant gas into the first cylinder 38 is inserted into and connected to the sleeve 141, and one end of this refrigerant introducing tube 92 communicates with the suction passage 58 of the first cylinder 38. The other end of the refrigerant introducing tube 92 opens in an accumulator 146.

One end of the refrigerant introducing tube 94 for introducing the refrigerant gas into the second cylinder 40 is inserted into the sleeve 142, and one end of this refrigerant introducing tube 94 communicates with the suction passage 60 of the second cylinder 40. The other end of the refrigerant introducing tube 94 opens in the accumulator 146 in the same manner as in the refrigerant introducing tube 92.

The accumulator 146 is a tank which separates a sucked refrigerant into a gas and a liquid, and attached to the side surface of an upper part of the container main body 12A of the sealed container 12 via a bracket 147. Moreover, the refrigerant introducing tubes 92, 94 are inserted into the accumulator 146 from a bottom part, and an opening of the other end of each tube is positioned in an upper part of the accumulator 146. One end of the refrigerant pipe 100 is inserted into the upper part of the accumulator 146.

It is to be noted that the discharge sound muffling chamber 64 is connected to the discharge sound muffling chamber 62 via a communication path 120 which extends through the first and second cylinders 38, 40 and the intermediate partition plate 36 in an axial center direction (vertical direction). Moreover, the high-temperature high-pressure refrigerant gas compressed by the second rotary compression element 34 and discharged to the discharge sound muffling chamber 64 is discharged to the discharge sound muffling chamber 62 via the communication path 120, and combined with the high-temperature high-pressure refrigerant gas compressed by the first rotary compression element 32.

Moreover, the discharge sound muffling chamber 62 is connected to the sealed container 12 via a hole (not shown) which extends through the cup member 63. The high-temperature high-pressure refrigerant gas compressed by the first and second rotary compression elements 32 and 34 and discharged to the discharge sound muffling chamber 62 is discharged into the sealed container 12 via this hole.

On the other hand, the rotary compression mechanism section 18 is provided with a power saving mechanism 160. The power saving mechanism 160 connects the high-pressure chamber side of the first cylinder 38 to the low-pressure chamber side of the second cylinder 40 with a predetermined phase. That is, the power saving mechanism 160 connects the high-pressure chamber side of the first cylinder 38 to the low-pressure chamber side of the second cylinder 40 in the vicinity of a phase angle of the first vane 50 in which the discharge valve 47A opens during a small-capacity operation of the refrigerant circuit. In the present embodiment.

A through hole 168 described later is formed in an inner wall surface of the first cylinder 38 in the vicinity of a phase angle of 120° of the first roller 46 in which the discharge valve 47A opens (when the first roller 46 rotates by about 100° to 140° in a rotating direction of the first roller 46 from a top dead center in which the first roller passes the guide groove 70 of the first vane 50) in an operation state in which a compression work (kW) of the rotary compressor 10 drops to a predetermined lower limit value (e.g., 2.3 kW or the like).

Main constituting members of the power saving mechanism 160 are: a communication hole 162 extending through outer peripheral portions of both of the cylinders 38, 40 and the intermediate partition plate 36 in the vertical direction; a pair of upper and lower piston valves 164, 165 slidably held in the communication hole 162; a spring 167 as a spring member which abuts on one surface of each of these piston valves 164, 165 to urge them in such a direction as to depart them from each other; through holes 168, 170 which connect the communication hole 162 to the high-pressure chamber side of the first cylinder 38 and the low-pressure chamber side of the second cylinder 40, respectively; and a refrigerant introducing hole 172 and a refrigerant introducing tube 174 for applying refrigerant pressures to the other surfaces of both of the piston valves 164, 165 as described later. It is to be noted that in the intermediate partition member 36, an inner diameter of the communication hole 162 is formed to be smaller than an outer diameter of each of the piston valves 164, 165.

The spring 167 is set so as to be completely compressed, when a high pressure having a value that is not less than a predetermined value is applied from the surface (other surface) of each of the piston valves 164, 165 which does not abut on the spring.

The communication hole 162 is connected to both of the cylinders 38, 40 via the through holes 168, 170 formed in the vicinity of the intermediate partition plate 36. The refrigerant introducing hole 172 parallel to the communication hole 162 is formed so as to extend through both of the cylinders 38, 40 and the intermediate partition plate 36, and the refrigerant gas from the refrigerant introducing tube 174 is introduced into the refrigerant introducing hole 172. The refrigerant introducing tube 174 is formed in a horizontal direction in the intermediate partition plate 36, the tube is inserted into and connected to the refrigerant introducing hole 172 and a hole which opens in the sealed container 12, and one end of the tube opens in the refrigerant introducing hole 172. Furthermore, communication recessed portions 176, 178 for connecting the communication hole 162 to the refrigerant introducing hole 172 are formed in a portion of the lower surface of the upper support member 54 corresponding to an upper end of the communication hole 162 and a portion of the upper surface of the lower support member 56 corresponding to a lower end of the communication hole 162.

On the other hand, a refrigerant pipe 101 is connected to an intermediate portion of the refrigerant pipe 100, and the refrigerant pipe 101 is connected to the refrigerant introducing tube 174 via an electromagnetic valve 105. A refrigerant pipe 102 is also connected to an intermediate portion of the refrigerant discharge tube 96, and connected to the refrigerant introducing tube 174 via an electromagnetic valve 106 in the same manner as in the refrigerant pipe 101. It is to be noted that the electromagnetic valves 105, 106 are controlled to open or close by a controller C1 described later.

Here, the controller C1 is control means for controlling the exterior unit AO, and is constituted of a CPU, a ROM, a RAM and the like. This controller C1 transmits and receives a signal with respect to a controller C2 of the interior unit AI. A rotation number of the rotary compressor 10 (multicylindrical rotary compressor) is controlled by the inverter INV in accordance with a built-in control program based on a control signal from this controller C2, input information from sensors S1, S2 which detect a secondary current or voltage and a primary current or voltage from the inverter INV, respectively, and the like. It is to be noted that the controller C1 controls the electromotive element 14 (DC motor) of the rotary compressor 10 in a range of a preset maximum rotation number HzMAX (e.g., 150 Hz) and minimum rotation number HzMIN (e.g., 10 Hz). The controller C1 also controls the power saving mechanism 160.

The controller C2 transmits a control signal to the controller C1 in such a manner as to bring a temperature Tr of a space to be cooled to a desired set value Trs based on an output from a temperature sensor which detects the temperature Tr of the space to be cooled by the interior heat exchanger 156 (use-side heat exchanger).

That is, the controller C2 transmits a control signal to the controller C1 in such a manner as to increase a compression work of the rotary compressor 10 in a case where the temperature Tr of the space to be cooled is higher than the set value Trs. The controller C1 which has received this control signal controls the inverter INV to raise the rotation number of the electromotive element 14 while regarding the maximum rotation number HzMAX as an upper limit. To raise the rotation number of the electromotive element 14 against a load, a secondary current flowing from the inverter INV to the electromotive element 14 also rises, and the compression work (kW) of the rotary compressor 10 also rises. Accordingly, since an amount of the refrigerant circulated in the refrigerant circuit increases, a freezing capacity of the refrigerant circuit increases, and the space to be cooled is strongly cooled by the interior heat exchanger 156.

The controller C2 transmits the control signal to the controller C1 every predetermined sampling period. Moreover, in a case where the temperature Tr of the space to be cooled is still higher than the set value Trs, the controller transmits such a control signal as to raise the compression work of the rotary compressor 10. In the same manner as described above, the controller C2 further raises the rotation number of the electromotive element 14 as much as a predetermined step (the maximum rotation number HzMAX is an upper limit), and raises the compression work of the rotary compressor 10 to further raise the freezing capacity of the refrigerant circuit.

When the temperature Tr of the space to be cooled drops and comes close to the set value Trs by such cooling, the controller C2 transmits to the controller C1 such a control signal as to lower the compression work of the rotary compressor 10 this time. The controller C1 which has received this control signal controls the inverter INV to lower the rotation number of the electromotive element 14 by a predetermined step while regarding the minimum rotation number HzMIN as a lower limit. Since a load on the electromotive element 14 is lightened owing to the drop of the rotation number, the secondary current flowing from the inverter INV to the electromotive element 14 drops, and the compression work (kW) of the rotary compressor 10 also drops. Consequently, since the amount of the refrigerant circulated in the refrigerant circuit decreases, a freezing capacity of the refrigerant circuit drops, and a cooling effect of the space to be cooled weakens.

Similarly, the controller C2 transmits the above-described control signal to the controller C1 every predetermined sampling period. Moreover, when the temperature Tr of the space to be cooled still drops to be lower than, for example, the set value Trs, the controller transmits such a control signal as to lower the compression work. The controller C2 further lowers the rotation number of the electromotive element 14 by the predetermined step (the minimum rotation number HzMIN is the lower limit), and lowers the compression work of the rotary compressor 10 to lower the freezing capacity of the refrigerant circuit more.

Here, the sensor S1 detects the secondary current and the secondary voltage of the inverter INV (output current and voltage of the inverter INV). Moreover, the sensor S2 detects the primary current and the primary voltage of the inverter INV (input current and voltage of the inverter INV) to output them to the controller C1, respectively. Furthermore, the controller C1 calculates the compression work (kW) of the rotary compressor 10 from the secondary current and secondary voltage (inputs of the electromotive element 14) of the inverter INV detected by the sensor S1.

The controller C1 turns off the power saving mechanism 160 in a case where the compression work (kW) of the rotary compressor 10 calculated in this manner is higher than a predetermined lower limit value WL (e.g., 2.3 kW or the like) (usual operation). That is, the controller C1 closes the electromagnetic valve 105 and opens the electromagnetic valve 106 during the usual operation to thereby connect the refrigerant discharge tube 96 to the refrigerant introducing tube 174.

Accordingly, a discharge-side pressure of the rotary compressor 10 is applied to the upper surface of the piston valve 164 and the lower surface of the piston valve 165. When the discharge-side pressure is applied, the spring 167 is pushed in a vertical direction by both of the piston valves 164, 165, and completely compressed. Moreover, since both of the through holes 168, 170 are completely closed by outer peripheral surfaces of both of the piston valves 164, 165, any refrigerant is not circulated in the first and second cylinders 38, 40.

Since the high-pressure chamber side of the first cylinder 38 is not connected to the low-pressure chamber side of the second cylinder 40 in this state, both of the rotary compression elements 32 and 34 operate 100%.

On the other hand, when the temperature Tr of the space to be cooled drops, the load lightens, and the compression work (kW) of the rotary compressor 10 calculated as described above drops to the lower limit value WL or less (this state corresponds to a small-capacity operation in which the freezing capacity of the refrigerant circuit decreases) as described above, the controller C1 turns on the power saving mechanism 160. That is, the controller opens the electromagnetic valve 105, and closes the electromagnetic valve 106 during such small-capacity operation. Accordingly, the refrigerant pipe 100 is connected to the refrigerant introducing tube 174, and a suction-side pressure of the rotary compressor 10 is applied to the upper surface of the piston valve 164 and the lower surface of the piston valve 165.

In this case, since a spring force is larger than the suction-side pressure applied to one surface of each of the piston valves 164, 165, the piston valve 164 and the piston valve 165 are urged by the spring 167 in such a direction as to detach them from each other. The piston valve 164 is pressed onto the lower surface of the upper support member 54, and the piston valve 165 is pressed onto the upper surface of the lower support member 56. Accordingly, both of the through holes 168, 170 are opened to connect the high-pressure chamber side of the first cylinder 38 to the low-pressure chamber side of the second cylinder 40, and a part of the refrigerant of the first cylinder 38 on the high-pressure chamber side flows into the second cylinder 40 on the low-pressure chamber side.

Accordingly, a part of the refrigerant of the first cylinder 38 on the high-pressure chamber side escapes toward the low-pressure chamber side of the second cylinder 40. It is to be noted that when the refrigerant of the first cylinder 38 on the high-pressure chamber side escapes toward the low-pressure chamber side of the second cylinder 40, an amount of the refrigerant discharged from the first cylinder 38 decreases, and an amount of the refrigerant sucked into the second cylinder 40 decreases. Therefore, a volume efficiency of the rotary compressor 10 drops. Since the amount of the circulated refrigerant flowing through the refrigerant circuit also drops owing to the drop of the volume efficiency, the freezing capacity of the refrigerant circuit further drops. Therefore, the temperature of the space to be cooled by the interior heat exchanger 156 rises.

When the temperature of the space to be cooled rises, the controller C2 transmits to the controller C1 such a control signal as to increase the compression work of the rotary compressor 10. The controller C1 which has received this control signal raises the rotation number of the electromotive element 14 of the rotary compressor 10 by the predetermined step by the inverter INV as described above.

Accordingly, the rotation number of the electromotive element 14 of the rotary compressor 10 is maintained to be high even during such small-capacity operation, and it is possible to suppress the drop of the operation efficiency of the electromotive element 14 and the increase of the refrigerant leakage losses in the rotary compression elements 32 and 34 with a low rotation number.

Moreover, the high-pressure chamber side of the first cylinder 38 is connected to the low-pressure chamber side of the second cylinder 40 in the vicinity of a phase angle of 120° of the first roller 46 in which the discharge valve 47A opens in an operation state in which the compression work (kW) of the rotary compressor 10 drops to a predetermined lower limit value (e.g., 2.3 kW or the like). Accordingly, the refrigerant of the first cylinder in the high-pressure chamber side can be released to the low-pressure chamber side of the second cylinder with a good efficiency.

It is to be noted that when the compression work of the rotary compressor 10 calculated as described above rises to a predetermined reset value WR (e.g., 2.5 kW or the like) as described above, the controller C1 turns off the power saving mechanism 160 to reset the rotary compression elements 32 and 34 to 100% operation.

An operation of an air conditioner constituted as described above will be described. The controller C1 controls the inverter INV to drive the electromotive element 14 based on an operation instruction of the controller C2 of the interior unit AI. It is to be noted that during starting, the controller C1 closes the electromagnetic valve 105 of the refrigerant pipe 101, and opens the electromagnetic valve 106 of the refrigerant pipe 102. Accordingly, the refrigerant pipe 102 is connected to the refrigerant introducing tube 174, and the discharge-side pressure of the rotary compressor 10 is applied to the upper surface of the piston valve 164 and the lower surface of the piston valve 165. When the discharge-side pressure is applied, the spring 167 is pressed by both of the piston valves 164, 165 in the vertical direction, and completely compressed. Moreover, since both of the through holes 168, 170 are completely closed by the outer peripheral surfaces of both of the piston valves 164, 165, any refrigerant is not circulated in the first cylinder 38 and the second cylinder 40.

Since the high-pressure chamber side of the first cylinder 38 is not connected to the low-pressure chamber side of the second cylinder 40 in this state, both of the rotary compression elements 32 and 34 operate 100%.

Moreover, when the electromotive element 14 starts to rotate the rotor 24, the first and second rollers 46, 48 fitted into the upper and lower eccentric portions 42, 44 disposed integrally with the rotation shaft 16 eccentrically rotate in the first and second cylinders 38, 40.

Accordingly, the low-pressure refrigerant flows from the refrigerant pipe 100 of the rotary compressor 10 into the accumulator 146. Since the electromagnetic valve 105 of the refrigerant pipe 100 is closed as described above, all the refrigerant passing through the refrigerant pipe 100 flows into the accumulator 146 without flowing into the refrigerant introducing tube 174.

Moreover, after the low-pressure refrigerant flowing into the accumulator 146 is separated into the gas and the liquid, the only refrigerant gas enters the respective refrigerant discharge pipes 92, 94 which open in the accumulator 146. The low-pressure refrigerant gas entering the refrigerant introducing pipe 92 is sucked into the low-pressure chamber side of the first cylinder 38 of the first rotary compression element 32 via the suction passage 58.

The refrigerant gas sucked into the first cylinder 38 on the low-pressure chamber side is compressed by the operations of the first roller 46 and the first vane 50 to form a high-temperature high-pressure refrigerant gas. The gas passes through the discharge port 47 from the high-pressure chamber side of the first cylinder 38, and is discharged to the discharge sound muffling chamber 62.

On the other hand, the low-pressure refrigerant gas entering the refrigerant introducing pipe 94 passes through the suction passage 60, and is sucked into the low-pressure chamber side of the second cylinder 40 of the second rotary compression element 34. The refrigerant gas sucked into the second cylinder 40 on the low-pressure chamber side is compressed by the operations of the second roller 48 and the second vane 52.

Thereafter, the refrigerant gas compressed in the second cylinder 40 is discharged from the high-pressure chamber side of the second cylinder 40 through the discharge port 49 to the discharge sound muffling chamber 64. The gas is discharged to the discharge sound muffling chamber 62 via the communication path 120, and is combined with the refrigerant compressed by the first rotary compression element 32. The combined refrigerant is discharged into the sealed container 12 from a hole (not shown) which extends through the cup member 63.

Thereafter, the refrigerant in the sealed container 12 is discharged to the outside from the refrigerant discharge tube 96 formed in the end cap 12B of the sealed container 12, and flows into the exterior heat exchanger 152. Here, since the electromagnetic valve 106 of the pipe 102 is opened as described above, a part of the discharge-side refrigerant of each of the rotary compression elements 32 and 34, passed through the refrigerant discharge tube 96, enters the refrigerant introducing tube 174 from the refrigerant pipe 102, and is applied to the upper surface of the piston valve 164 and the lower surface of the piston valve 165.

On one hand, when the refrigerant gas flows into the exterior heat exchanger 152, the gas radiates heat. After the pressure of the gas is reduced by the expansion valve 154, the gas flows into the interior heat exchanger 156. The refrigerant evaporates in the interior heat exchanger 156, and absorbs the heat from air circulated in a room to thereby exert a cooling function of cooling the inside of the room. Moreover, the refrigerant flows out of the interior heat exchanger 156, and is sucked into the rotary compressor 10. This cycle is repeated.

On the other hand, when the temperature Tr of the space to be cooled drops, the load lightens, and the compression work (kW) of the rotary compressor 10 calculated as described above drops to the lower limit value WL or less (small-capacity operation), the controller C1 turns on the power saving mechanism 160. That is, the controller C1 opens the electromagnetic valve 105, and closes the electromagnetic valve 106. Accordingly, the refrigerant pipe 100 is connected to the refrigerant introducing tube 174, and the suction-side pressure of the rotary compressor 10 is applied to the upper surface of the piston valve 164 and the lower surface of the piston valve 165.

At this time, since the spring force of the spring is larger than the suction-side pressure applied to one surface of each of the piston valves 164, 165, the piston valves 164, 165 are urged by the spring 167 in such a direction as to detach them from each other, the piston valve 164 is pressed onto the lower surface of the upper support member 54, and the piston valve 165 is pressed onto the upper surface of the lower support member 56. Accordingly, both of the through holes 168, 170 are opened, the high-pressure chamber side of the first cylinder 38 is connected to the low-pressure chamber side of the second cylinder 40, and a part of the refrigerant on the high-pressure chamber side of the first cylinder 38 flows into the low-pressure chamber side of the second cylinder 40.

Accordingly, a part of the refrigerant on the high-pressure chamber side of the first cylinder 38 escapes toward the low-pressure chamber side of the second cylinder 40. When the refrigerant on the high-pressure chamber side of the first cylinder 38 escapes toward the low-pressure chamber side of the second cylinder 40, the amount of the refrigerant discharged from the first cylinder 38 decreases, and the amount of the refrigerant sucked into the second cylinder 40 decreases. Therefore, the volume efficiency of the rotary compressor 10 drops. Since the amount of the circulated refrigerant flowing through the refrigerant circuit drops owing to the drop of the volume efficiency, the freezing capacity of the refrigerant circuit drops more. Therefore, the temperature of the space to be cooled by the interior heat exchanger 156 rises as described above.

When the temperature of the space to be cooled rises, the controller C2 transmits to the controller C1 such a control signal as to raise the compression work of the rotary compressor 10. The controller C1 which has received this control signal raises the rotation number of the electromotive element 14 of the rotary compressor 10 by the predetermined step by the inverter INV in the same manner as described above.

Moreover, when the compression work of the rotary compressor 10 calculated as described above rises to the predetermined reset value WR (e.g., 2.5 kW or the like), the controller C1 turns off the power saving mechanism 160, closes the electromagnetic valve 105, and opens the electromagnetic valve 106. Accordingly, the refrigerant discharge tube 96 communicates with the refrigerant introducing tube 174, and the discharge-side pressure of the rotary compressor 10 is applied to the upper surface of the piston valve 164 and the lower surface of the piston valve 165. Therefore, since both of the through holes 168, 170 are completely closed, any refrigerant is not circulated in the first and second cylinders 38, 40, and the rotary compression elements 32 and 34 can be reset to the 100% operation.

As described above, since the refrigerant circuit of the air conditioner is constituted in the rotary compressor 10, and controlled by the controller C1 as described above, performance and reliability of the whole air conditioner can be enhanced.

It is to be noted that in the present embodiment, the controller C1 calculates the compression work of the rotary compressor 10. When the compression work reaches the predetermined lower limit value WL, the controller turns on the power saving mechanism 160. When the work reaches the predetermined reset value, the controller turns off the mechanism. However, the control is not limited to the control to turn on and off the power saving mechanism 160 depending on such compression work, and any control may be executed as long as the power saving mechanism 160 is operated during the small-capacity operation of the refrigerant circuit. For example, the power saving mechanism is effectively controlled to be on or off depending on the rotation number of the rotary compressor 10.

Moreover, the rotation shaft 16 has been described by use of the vertically disposed rotary compressor in the above-described embodiment, but, needless to say, in the present invention, the rotation shaft may be applied to a horizontally disposed rotary compressor. Furthermore, needless to say, the present invention may be applied to a multicylindrical rotary compressor provided with three cylinders or more rotary compression elements.

What is claimed is:

1. An air conditioner having a multicylindrical rotary compressor in which a driving element and first and second rotary compression elements driven by a rotation shaft of the driving element are stored in a sealed container, the air conditioner comprising:

a control means, comprising at least:

an interior-unit controller; and an exterior-unit controller;

an exterior unit;

an interior unit; and a pipe connecting the exterior unit to the interior unit;

the interior unit comprising:

an expansion valve connected to the pipe;

an interior heat exchanger connected to the expansion valve; and the interior-unit controller, wherein the interior-unit controller is in communication with the expansion valve and the interior heat exchanger;

the exterior unit comprising:

an exterior heat exchanger;

the multicylindrical rotary compressor;

the exterior-unit controller; and a refrigerant discharge tube being connected to the multicylindrical rotary compressor and an inlet of the exterior heat exchanger;

the first and second rotary compression elements comprising:

first and second cylinders, wherein at least the first cylinder is provided with a suction passage;

first and second rollers fitted into eccentric portions formed on the rotation shaft to eccentrically rotate in the respective cylinders, respectively; and first and second vanes which abut on the first and second rollers to divide each cylinder into a low-pressure chamber side and a high-pressure chamber side, respectively, the compressor comprising:

a power saving mechanism which connects the high-pressure chamber side of the first cylinder to the low-pressure chamber side of the second cylinder with a predetermined phase, with said predetermined phase being between 100 and 140 degrees, a through hole being formed in an inner wall surface of the first cylinder 100 to 140 degrees in a rotating direction from a guide groove of the first vane, a communication hole being formed to extend through an outer peripheral portion of the first cylinder, a refrigerant introducing hole being formed to extend through the first cylinder; and the control means for controlling an operation of the power saving mechanism and a rotation number of the driving element, the control means operating the power saving mechanism during a small-capacity operation of a refrigerant circuit constituted in the multicylindrical rotary compressor to connect the high-pressure chamber side of the first cylinder to the low-pressure chamber side of the second cylinder and to thereby raise the rotation number of the driving element, wherein said exterior-unit controller controls the operation of said power saving mechanism and said rotation number of the driving element on the basis of information gathered by said interior-unit controller and transmitted by said interior-unit controller to said exterior-unit controller, wherein the through hole is less than 180 degrees in the rotating direction from the suction passage, and wherein the guide groove is disposed between the through hole and the suction passage in the rotating direction, wherein the refrigerant introducing hole is parallel to the communication hole, wherein the through hole connects the communication hole to the high-pressure side of the first cylinder.

2. The air conditioner according to claim 1, further comprising:

a discharge port for discharging the refrigerant compressed in the first cylinder; a discharge valve opening and closing the discharge port, the control means controlling the power saving mechanism to connect the high-pressure chamber side of the first cylinder to the low-pressure chamber side of the second cylinder in the vicinity of a phase angle of the first roller in which the discharge valve opens during the small-capacity operation of the refrigerant circuit.

3. The air conditioner according to claim 2, wherein the control means comprises a CPU, a ROM or a RAM.

4. The air conditioner according to claim 1, wherein the first roller is out of phase with the second roller.

5. The air conditioner according to claim 4, wherein a phase difference between the first roller and the second roller is 180 degrees.

* * * * *